US007325340B2

(12) United States Patent
Chen

(10) Patent No.: US 7,325,340 B2
(45) Date of Patent: Feb. 5, 2008

(54) CALENDAR HOLDER

(75) Inventor: Ying-Chou Chen, Taipei (TW)

(73) Assignee: Design Advertising Co., Ltd., Taipei (TW)

( * ) Notice: Subject to any disclaimer, the term of this patent is extended or adjusted under 35 U.S.C. 154(b) by 0 days.

(21) Appl. No.: 11/358,566

(22) Filed: Feb. 21, 2006

(65) Prior Publication Data

US 2006/0225317 A1 Oct. 12, 2006

(30) Foreign Application Priority Data

Mar. 22, 2005 (TW) ..... 94204548 U

(51) Int. Cl.
*B42D 5/04* (2006.01)
*G09D 3/00* (2006.01)
*G09F 3/18* (2006.01)

(52) U.S. Cl. ..... 40/120; 40/661

(58) Field of Classification Search ..... 40/120, 40/336, 658, 666, 661.08, 113, 124; 248/443, 248/442.2, 447.2

See application file for complete search history.

(56) References Cited

U.S. PATENT DOCUMENTS 2,149,978 A * 3/1939 Noel ..... 248/459
2,604,724 A * 7/1952 Watts ..... 281/44
4,969,623 A * 11/1990 Bernier ..... 248/441.1

* cited by examiner

*Primary Examiner*—Cassandra Davis
(74) *Attorney, Agent, or Firm*—Alan Kamrath; Kamrath & Associates PA

(57) ABSTRACT

A calendar holder includes a support bracket, and a calendar mounted on the support bracket. The support bracket has a first portion formed with a first plate for supporting the calendar, a second portion formed with a second plate parallel with the first plate and a third portion formed with a bendable third plate perpendicular to the second plate. Thus, the support bracket is mounted on the display directly to attach the calendar to the display to facilitate a user watching the calendar. In addition, the support bracket is mounted on the display easily and rapidly, thereby facilitating the user mounting the calendar holder. Further, the calendar holder is mounted on the display directly without occupying additional space, thereby facilitating the user storing the calendar holder.

16 Claims, 5 Drawing Sheets

CALENDAR HOLDER

BACKGROUND OF THE INVENTION

1. Field of the Invention

The present invention relates to a holder and, more particularly, to a calendar holder.

2. Description of the Related Art

A conventional calendar holder comprises a support bracket, and a calendar mounted on the support bracket. However, when the calendar holder is placed on the table, the calendar holder occupies a lot of space of the table, thereby causing inconvenience to the user.

SUMMARY OF THE INVENTION

In accordance with the present invention, there is provided a calendar holder, comprising a support bracket, and a calendar mounted on the support bracket. The support bracket has a first portion formed with a first plate for supporting the calendar, a second portion formed with a second plate parallel with the first plate and a third portion formed with a bendable third plate perpendicular to the second plate.

The primary objective of the present invention is to provide a calendar holder, wherein the support bracket is mounted on the display directly to attach the calendar to the display to facilitate a user watching the calendar.

Another objective of the present invention is to provide a calendar holder, wherein the support bracket is mounted on the display easily and rapidly, thereby facilitating the user mounting the calendar holder.

A further objective of the present invention is to provide a calendar holder, wherein the calendar holder is mounted on the display to enhance the outer appearance of the display.

A further objective of the present invention is to provide a calendar holder, wherein the calendar holder is mounted on the display directly without occupying additional space, thereby facilitating the user storing the calendar holder.

A further objective of the present invention is to provide a calendar holder, wherein the support bracket is formed integrally, thereby decreasing the costs of fabrication of the calendar holder.

Further benefits and advantages of the present invention will become apparent after a careful reading of the detailed description with appropriate reference to the accompanying drawings.

DETAILED DESCRIPTION OF THE INVENTION

Figure 1:
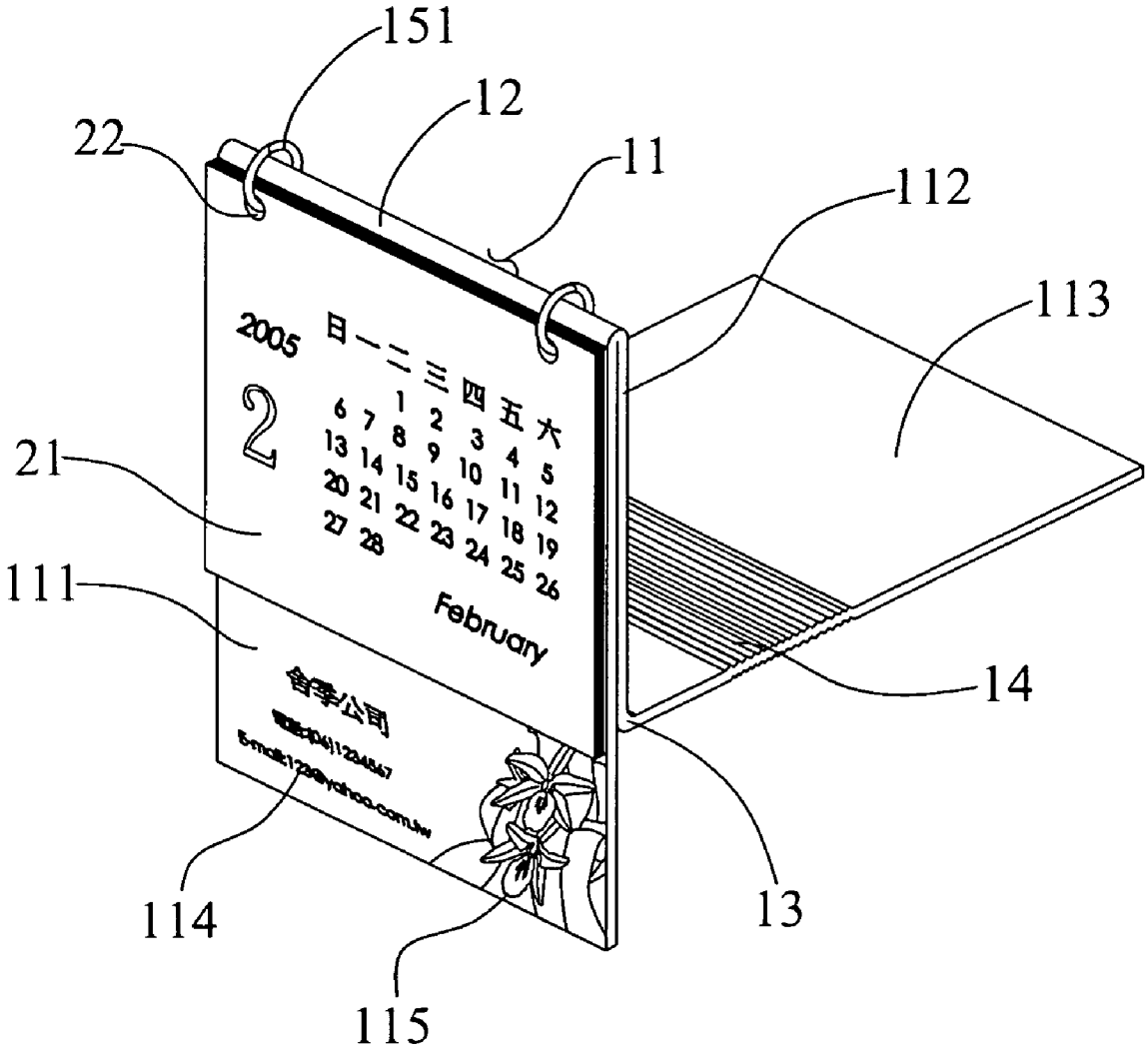
FIG. 1 is a perspective view of a calendar holder in accordance with the preferred embodiment of the present invention.
Figure 2:
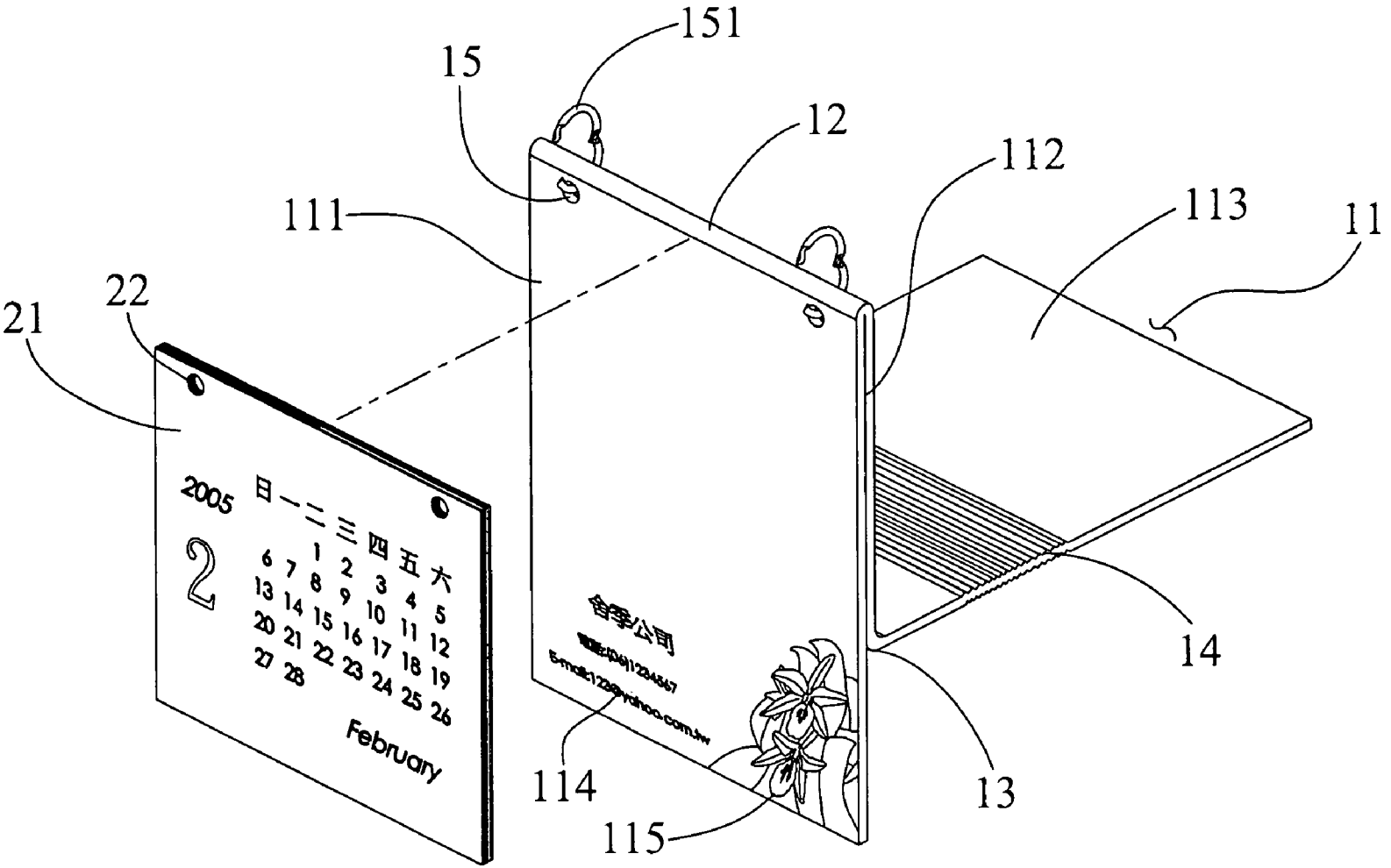
FIG. 2 is an exploded perspective view of the calendar holder as shown in FIG. 1.
Figure 3:
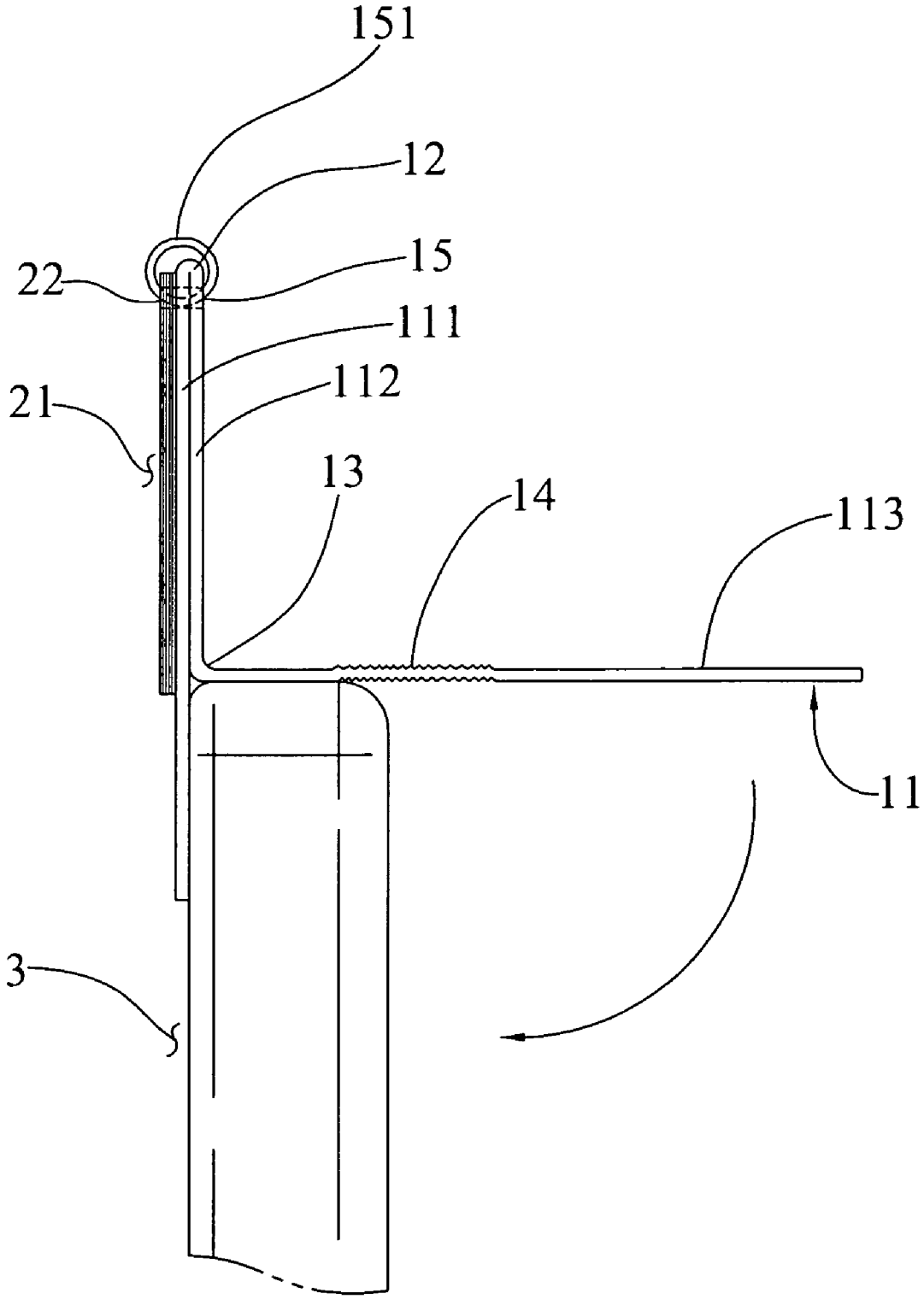
FIG. 3 is a plan view showing the calendar holder as shown in FIG. 1 being mounted on a display.

Referring to the drawings and initially to FIGS. 1-3, a calendar holder in accordance with the preferred embodiment of the present invention comprises a support bracket 11, and a calendar 21 mounted on the support bracket 11.

The support bracket 11 has a first portion formed with a first plate 111 for supporting the calendar 21, a second portion formed with a second plate 112 parallel with the first plate 111 and a third portion formed with a bendable third plate 113 perpendicular to the second plate 112.

The first plate 111 of the support bracket 11 is provided with characters 114 and patterns 115 located under the calendar 21.

The second plate 112 of the support bracket 11 is connected to the first plate 111 by a bending portion 12. The second plate 112 of the support bracket 11 is rested on and located adjacent to the first plate 111. Each of the first plate 111 and the second plate 112 of the support bracket 11 has an upper portion formed with two opposite through holes 15.

The third plate 113 of the support bracket 11 is connected to the second plate 112 by a bending portion 13 which is rested on and located at a mediate portion the first plate 111. The third plate 113 of the support bracket 11 has a mediate portion formed with a plurality of folding lines 14 so that the third plate 113 is bendable relative to the first plate 111 and the second plate 112.

The calendar 21 is rested on the first plate 111 of the support bracket 11. The calendar 21 is attached to the first plate 111 of the support bracket 11 by two mounting rings 151. The calendar 21 has an upper portion formed with two opposite through holes 22, and each of the two mounting rings 151 is extended through the respective through hole 22 of the calendar 21 and the respective through hole 15 of each of the first plate 111 and the second plate 112 of the support bracket 11 to attach the calendar 21 to the support bracket 11.

Figure 4:
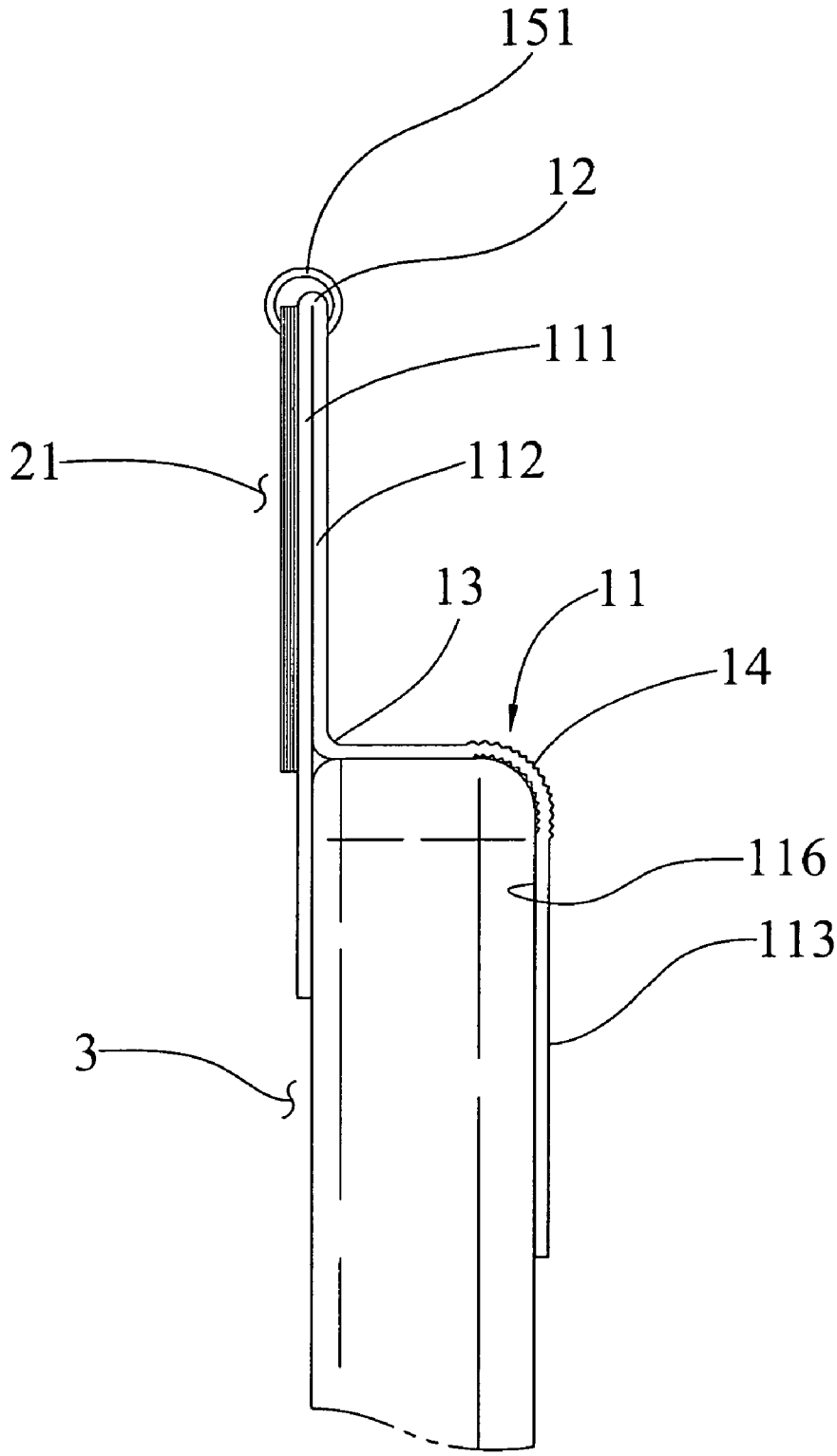
FIG. 4 is a schematic operational view of the calendar holder as shown in FIG. 3.
Figure 5:
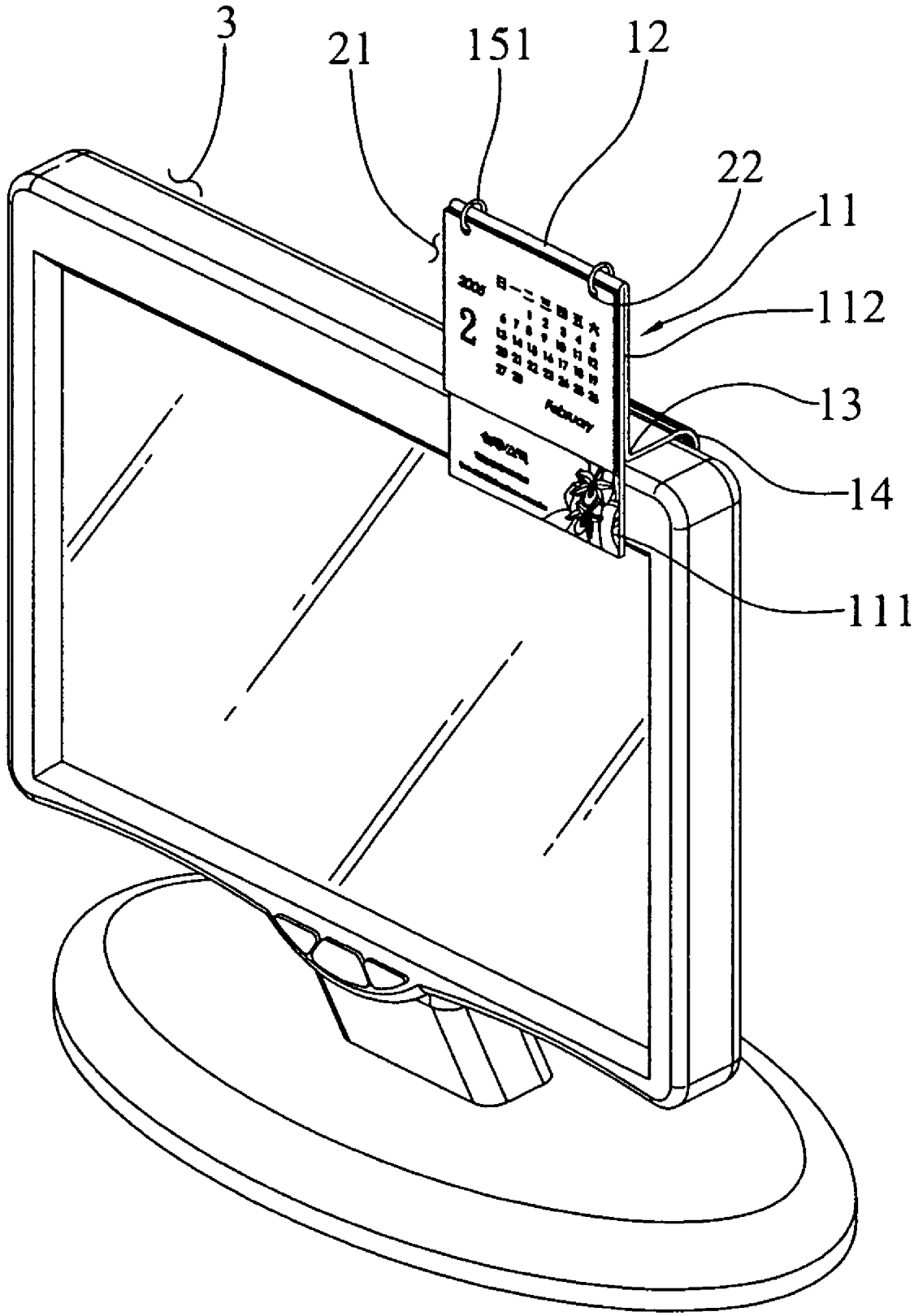
FIG. 5 is a perspective view showing the calendar holder as shown in FIG. 1 being mounted on the display.

In assembly, referring to FIGS. 3-5 with reference to FIGS. 1 and 2, when the support bracket 11 is mounted on a display 3 (such as a liquid crystal monitor), the third plate 113 of the support bracket 11 is placed on the top of the display 3 as shown in FIG. 3. Then, one of the folding lines 14 of the third plate 113 is bendable to bend the third plate 113 so that the third plate 113 is bendable relative to the first plate 111 and the second plate 112 to define a clamping space 116 between the third plate 113 and the first plate 111 to clamp the display 3 as shown in FIG. 4. Thus, when the third plate 113 is bendable relative to the first plate 111 and the second plate 112, the support bracket 11 has a substantially h-shaped cross-sectional profile as shown in FIG. 4 so as to clamp the display 3 closely. In such a manner, either one of the folding lines 14 of the third plate 113 is bendable to adjust the distance between the third plate 113 and the first plate 111 and to adjust the size of the clamping space 116 so as to fit the thickness of the display 3.

As shown in FIG. 5, the support bracket 11 is mounted on the display 3 directly to attach the calendar 21 to the display 3 to facilitate a user watching the calendar 21 directly.

Accordingly, the support bracket 11 is mounted on the display 3 directly to attach the calendar 21 to the display 3 to facilitate a user watching the calendar 21. In addition, the support bracket 11 is mounted on the display 3 easily and rapidly, thereby facilitating the user mounting the calendar holder. Further, the calendar holder is mounted on the display 3 to enhance the outer appearance of the display 3. Further, the calendar holder is mounted on the display 3 directly without occupying additional space, thereby facilitating the user storing the calendar holder. Further, the support bracket 11 is formed integrally, thereby decreasing the costs of fabrication of the calendar holder.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A calendar holder, comprising a support bracket, and a calendar mounted on the support bracket, wherein:

the support bracket has a first portion formed with a first plate for supporting the calendar, a second portion formed with a second plate parallel with the first plate and a third portion formed with a bendable third plate perpendicular to the second plate;

the third plate of the support bracket has a mediate portion formed with a plurality of folding lines so that the third plate is bendable relative to the first plate and the second plate.

2. The calendar holder in accordance with claim 1, wherein the second plate of the support bracket is connected to the first plate by a bending portion.

3. The calendar holder in accordance with claim 1, wherein the second plate of the support bracket is rested on the first plate.

4. The calendar holder in accordance with claim 1, wherein the second plate of the support bracket is located adjacent to the first plate.

5. The calendar holder in accordance with claim 1, wherein the third plate of the support bracket is connected to the second plate by a bending portion.

6. The calendar holder in accordance with claim 5, wherein the bending portion is rested on and located at a mediate portion the first plate.

7. The calendar holder in accordance with claim 1, wherein the calendar is rested on the first plate of the support bracket.

8. The calendar holder in accordance with claim 1, wherein the calendar is attached to the first plate of the support bracket by two mounting rings.

9. The calendar holder in accordance with claim 8, wherein each of the first plate and the second plate of the support bracket has an upper portion formed with two opposite through holes, the calendar has an upper portion formed with two opposite through holes, and each of the two mounting rings is extended through the respective through hole of the calendar and the respective through hole of each of the first plate and the second plate of the support bracket to attach the calendar to the support bracket.

10. The calendar holder in accordance with claim 1, wherein one of the folding lines of the third plate is bendable to bend the third plate so that the third plate is bendable relative to the first plate and the second plate to define a clamping space between the third plate and the first plate.

11. The calendar holder in accordance with claim 10, wherein either one of the folding lines of the third plate is bendable to adjust a size of the clamping space.

12. The calendar holder in accordance with claim 1, wherein the support bracket has a substantially h-shaped cross-sectional profile when the third plate is bendable relative to the first plate and the second plate.

13. The calendar holder in accordance with claim 1, wherein either one of the folding lines of the third plate is bendable to adjust a distance between the third plate and the first plate.

14. The calendar holder in accordance with claim 1, wherein the support bracket is formed integrally.

15. A calendar holder, comprising a support bracket, and a calendar mounted on the support bracket, wherein:

the support bracket has a first portion formed with a first plate for supporting the calendar, a second portion formed with a second plate parallel with the first plate and a third portion formed with a bendable third plate perpendicular to the second plate;

the third plate of the support bracket has a mediate portion formed with a plurality of folding lines so that the third plate is bendable relative to the first plate and the second plate;

the first plate of the support bracket is provided with characters located under the calendar.

16. A calendar holder, comprising a support bracket, and a calendar mounted on the support bracket, wherein:

the support bracket has a first portion formed with a fast plate for supporting the calendar, a second portion formed with a second plate parallel with the first plate and a third portion formed with a bendable third plate perpendicular to the second plate;

the third plate of the support bracket has a mediate portion formed with a plurality of folding lines so that the third plate is bendable relative to the first plate and the second plate;

the first plate of the support bracket is provided with patterns located under the calendar.

* * * * *